US008567932B2

(12) United States Patent
James, III et al.

(10) Patent No.: US 8,567,932 B2
(45) Date of Patent: Oct. 29, 2013

(54) FLUID CONTAINER HAVING FLUID INTERFACE FOR MICRO-FLUID APPLICATIONS

(75) Inventors: Edmund H. James, III, Lexington, KY (US); Neal D. McFarland, Versailles, KY (US); Steven R. Komplin, Lexington, KY (US); Randal S. Williamson, Georgetown, KY (US)

(73) Assignee: Funai Electric Co., Ltd. (JP)

( * ) Notice: Subject to any disclaimer, the term of this patent is extended or adjusted under 35 U.S.C. 154(b) by 189 days.

(21) Appl. No.: 13/234,671

(22) Filed: Sep. 16, 2011

(65) Prior Publication Data

US 2012/0120165 A1 May 17, 2012

Related U.S. Application Data

(63) Continuation-in-part of application No. 12/948,122, filed on Nov. 17, 2010, now Pat. No. 8,491,107.

(51) Int. Cl.
*B41J 2/175* (2006.01)
*B41J 2/17* (2006.01)

(52) U.S. Cl.
USPC ..... 347/86; 347/84; 347/85

(58) Field of Classification Search
USPC ..... 347/84, 85, 86
See application file for complete search history.

(56) References Cited

U.S. PATENT DOCUMENTS

| | | | | |
|---|---|---|---|---|
| 6,481,829 | B1 | 11/2002 | Bailey | |
| 6,550,899 | B1 | 4/2003 | Cowger | |
| 6,634,738 | B1 * | 10/2003 | Shinada et al. | 347/86 |
| 2002/0015608 | A1 | 2/2002 | Williams | |
| 2004/0135857 | A1 | 7/2004 | Hashii et al. | |
| 2010/0045755 | A1 * | 2/2010 | Kobayashi | 347/86 |

FOREIGN PATENT DOCUMENTS

| | | | |
|---|---|---|---|
| EP | 1547785 | A2 | 6/2004 |
| EP | 1547785 | A2 | 6/2005 |
| EP | 1623834 | A1 | 2/2006 |
| EP | 1772271 | A2 | 4/2007 |
| EP | 1772271 | A2 | 11/2007 |
| EP | 2039521 | A1 | 3/2009 |

* cited by examiner

*Primary Examiner* — Jannelle M Lebron
(74) *Attorney, Agent, or Firm* — Amster, Rothstein & Ebenstein LLP

(57) ABSTRACT

A consumable supply item for an imaging device holds an initial or refillable volume of ink. Users orient a housing to deplete the ink in a direction of gravity toward a bottom of the interior. The imaging device has a rotating latch. The latch mates with a top of the supply item to keep in place the supply item. Fluid exit and air venting ports reside on a side of the housing that gets inserted first into a container slot of the imaging device. A space separates the ports so a biasing member can push against the housing to assist in ejecting the supply item upon users activating the latch. The ports are separated a maximum distance to facilitate the ejection, while the exit port remains near a bottom to minimize stranding ink. Further embodiments note arrangements, distances and consumer features, to name a few.

6 Claims, 7 Drawing Sheets

FLUID CONTAINER HAVING FLUID INTERFACE FOR MICRO-FLUID APPLICATIONS

This application claims priority and benefit of parent U.S. patent application Ser. No. 12/948,122, filed Nov. 17, 2010, entitled "Fluid Container Having Mixing Chamber for Micro-Fluid Applications." The entirety of the parent application is incorporated herein by reference as if set forth herein.

FIELD OF THE INVENTION

The present invention relates to micro-fluid applications, such as inkjet printing. More particularly, although not exclusively, it relates to supply item containers that overcome settling problems associated with pigmented ink and to interfacing the container with an imaging device.

BACKGROUND OF THE INVENTION

The art of printing images with micro-fluid technology is relatively well known. A permanent or semi-permanent ejection head has access to a local or remote supply of fluid. The fluid ejects from an ejection zone to a print media in a pattern of pixels corresponding to images being printed. The fluid is dye or pigment based ink. With pigments, ink is known to have layers of differing concentrations. Sediments in a container settle downward over time leaving rich concentrations near a bottom, while leaner concentrations remain near a top. When printing, ink drawn from the bottom of a settled container leads first to excessively densely colors and later to excessively lightly colors. The former can also lead to clogging of ejection head nozzles as the largest particles accumulate together in micron-sized channels having fastidious fluid flow standards. Further, it may lead to increased viscosity making fluid ejection difficult.

Accordingly, a need exists in the art to deliver uniform concentrations of ink over a lifetime of container usage. Additional needs contemplate orienting the container to deliver essentially an entirety of ink to imaging devices, including features to properly interface the container with the imaging devices. Further benefits and alternatives are also sought when devising solutions.

SUMMARY OF THE INVENTION

The above-mentioned and other problems become solved with mixing chambers for supply item containers in micro-fluid applications, including latching and fluid interfaces.

A consumable supply item for an imaging device holds an initial or refillable volume of pigmented ink. Its housing defines an interior and exterior. The interior retains the ink and an exit port supplies it to an imaging device. Users orient the housing to deplete the ink in a direction of gravity toward a bottom surface of the interior where a mixing chamber resides. The chamber has inlet ports arranged to restrict to multiple different heights the entrance of the volume of ink from the interior. As ink draws into the chamber, sediments from different layers mix together. High-concentrated ink settled near a bottom of the container combines with less concentrated ink from above. Pigment settling is overcome during periods of inactivity. The design improves conventional wisdom requiring mechanical stirring and other techniques. It also limits entrainment of settled particles at the bottom of the container. It adds little cost yet provides substantial mixing of pigmented ink components. Further embodiments note chamber shapes, configuration of inlet ports, and construction of the supply item, to name a few.

The imaging device also has a rotating latch to keep in place the supply item during use. Users activate the latch to eject the supply item after use. The latch mates with a notch on a top exterior surface of the supply item. A first face of the notch engages a front of the latch, while a second face engages a side of the latch. The first face is angled to allow the latch to swing into and away from contact with the notch while the second face substantially parallels a side of the latch when the latch is engaged with the first face. The faces of the notch each have differing angles and differing lengths. Other embodiments recite degrees of angles, container slots to hold the supply item, and consumer features, to name a few.

Still further, the housing of the supply items notes fluid exit and air venting ports. They reside on a side of the housing that gets inserted first into the container slot of the imaging device. A space separates the ports so a biasing member can push against the housing to assist in ejecting the supply item upon users activating the latch. The ports are separated a maximum distance to facilitate ejection, while the exit port is situated near a bottom to minimize stranding ink. Further embodiments note port arrangements and distances.

These and other embodiments are set forth in the description below. Their advantages and features will be readily apparent to skilled artisans. The claims set forth particular limitations.

BRIEF DESCRIPTION OF THE DRAWINGS

The accompanying drawings incorporated in and forming a part of the specification illustrate several aspects of the illustrated embodiments, and together with the detailed description, serve to explain various principles. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the features of the invention, methods and apparatus include mixing chambers for ink containers to overcome settling problems associated with pigmented ink. Container features to interface latches and fluidic ports are also noted.

Figure 1A:
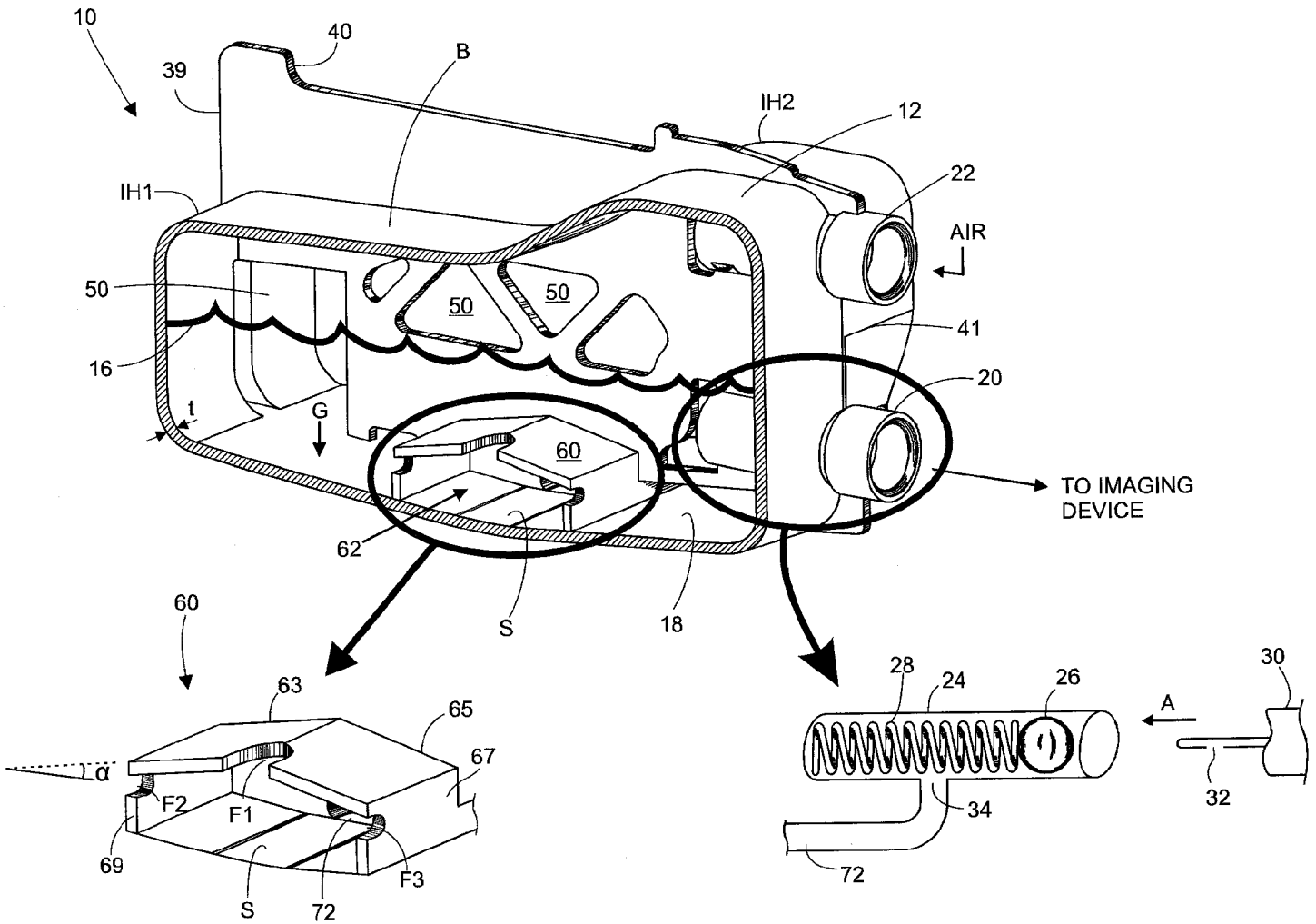
FIG. 1A is a perspective view in accordance with the present invention showing a supply item container having a mixing chamber, including enlarged isolation views.
Figure 1B:
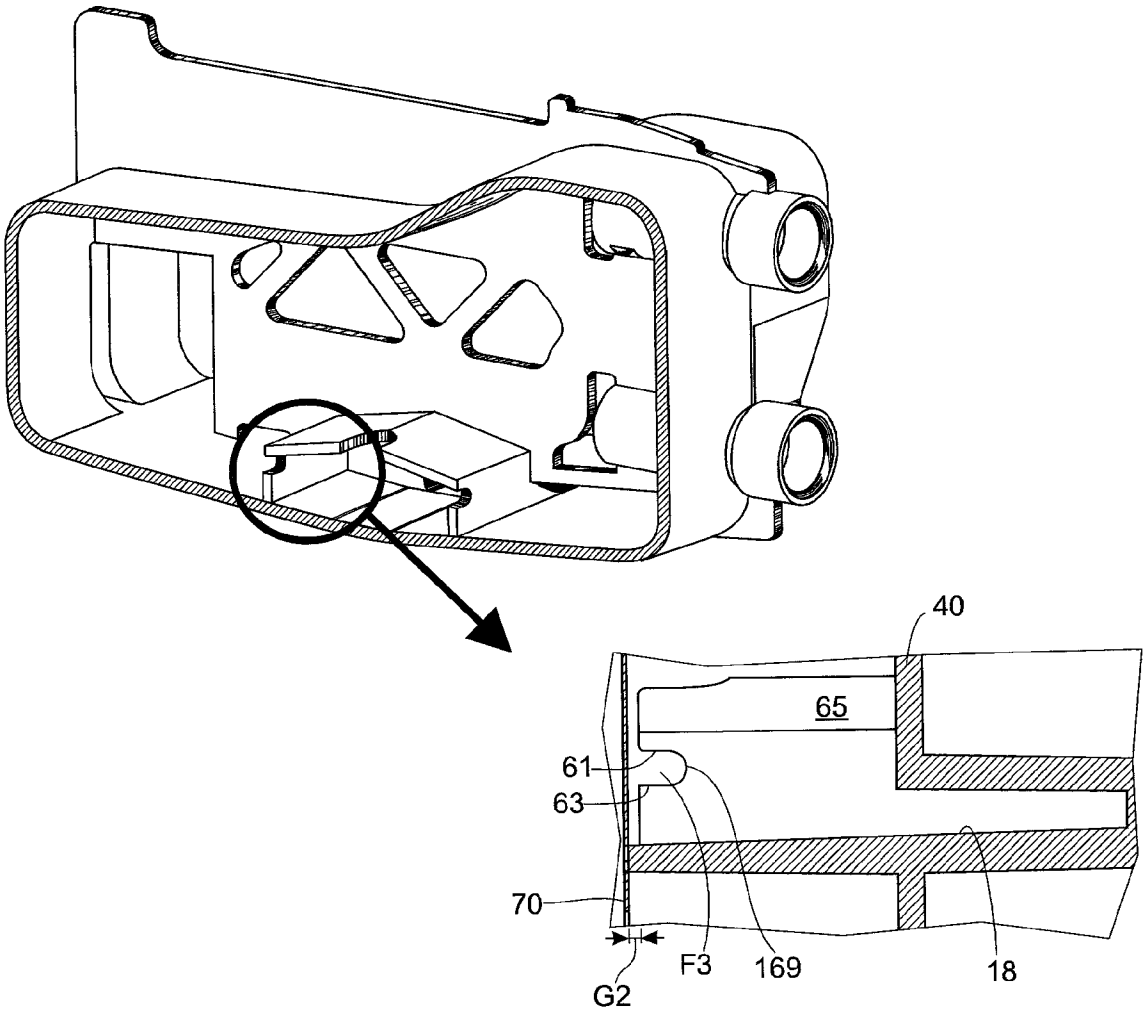
FIG. 1B is a repeat perspective view of FIG. 1A, including an enlarged isolation of a side diagrammatic view regarding the mixing chamber.
Figure 2:
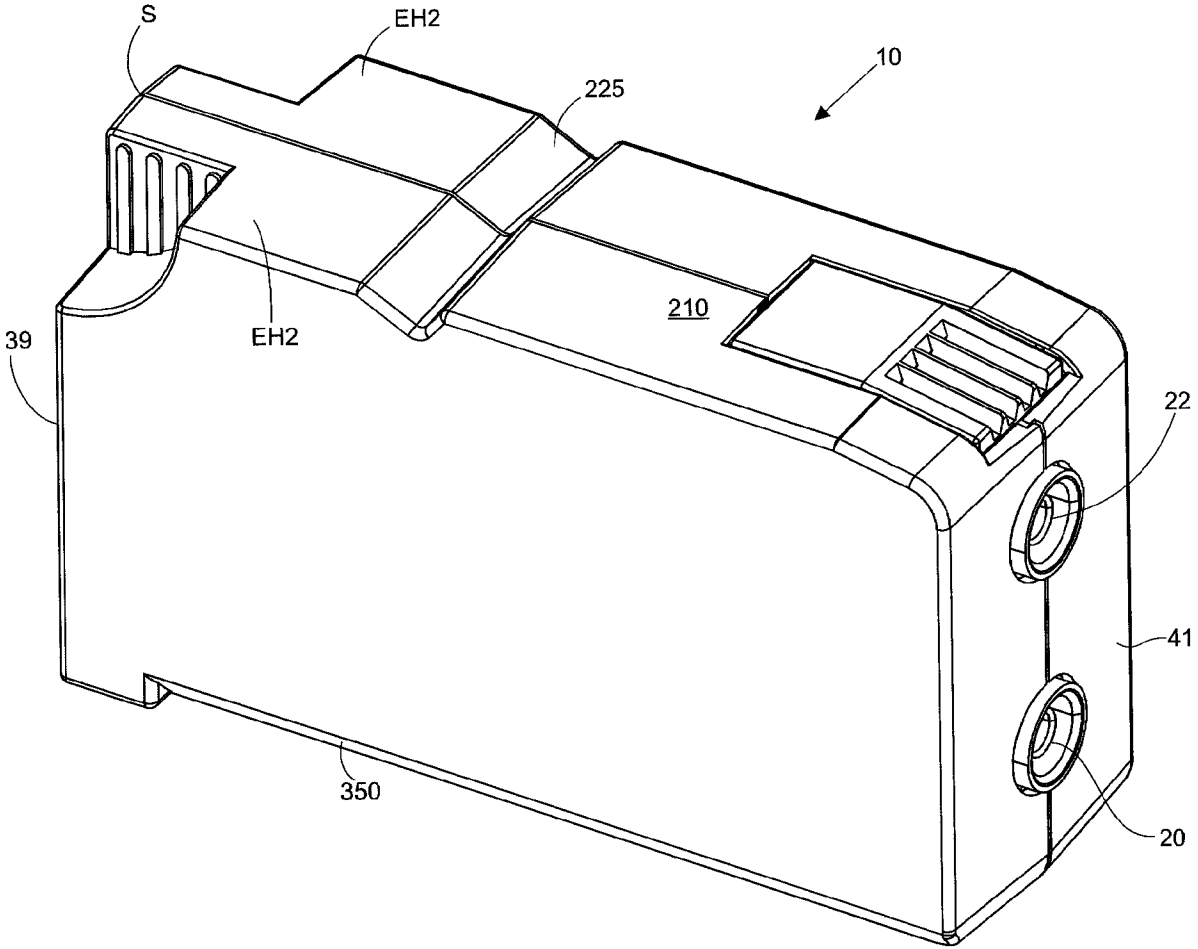
FIG. 2 is a perspective view of an exterior of the supply item of FIGS. 1A and 1B.

With reference to FIGS. 1A and 1B, a supply item 10 for use in an imaging device includes a structural support 12. The support defines an interior 14 that contains an initial or refillable supply of ink 16. The ink is any of a variety of aqueous inks, such as those based on dye or pigmented formulations. It also can typify varieties of color, such as cyan, magenta, yellow, black, etc. It can be used in many applications such as inkjet printing, medicinal delivery, forming circuit traces, etc.

During use, the volume of ink depletes downward toward a bottom surface 18 of the interior in a direction of gravity G. The bottom surface is generally flat or concaved upward to define a low point area or sump S from which the ink can be drawn. The ink flows out of the interior to the imaging device by way of an exit port 20. An air venting port 22 vertically aligned and above the exit port provides intake of ambient, recycled or other air to overcome backpressure that increases during imaging operations. The air venting port is also optimally at least 2 mm above the ink 16 in the interior when full. The exit and venting ports are any of a variety but typify cylindrical tubes 24 with an internal ball 26 and spring 28. They are mated with a septum needle 30 from the imaging device. The needle inserts into the port in the direction of the arrow A. It is pushed to overcome the bias of the spring and the ball slides backward. Upon sufficient insertion, openings 32, 34 in the port and needle are communicated so that a fluidic channel opens between the interior 14 and the needle.

At 60, a mixing chamber resides above the sump S. It has a chamber interior 62 in fluid communication between the interior 14 and the fluid exit port 20. It communicates directly with a passageway 72 that flows to the exit port 20 for use in the imaging device. Ink is substantially mixed in the chamber before entering the passageway. The mixture yields an optimal and continual concentration of pigment.

At least one continual wall or pluralities of wall sections define the size and shape of the mixing chamber. Pluralities of fluid inlet ports (F) reside in the wall(s). They are arranged to restrict the passage of a volume of fluid from the interior 14 into the chamber interior at multiple heights above the bottom surface of the interior. A first of the fluid inlet ports F1 is defined at an apex of the chamber. It is a topmost opening in a connecting wall defined by two inclined surfaces 63, 65 angling upward from two walls 67, 69 oriented upright from the bottom surface 18. The angle facilitates movement upward and exit at F1 of bubbles trapped in the chamber interior under the inclined surfaces. The angle $\alpha$ is any of a variety but ranges in certain embodiments from about nine to about thirteen degrees from horizontal. Preferably, the angle is about ten to eleven degrees. The port F1 also directs flow incoming to the chamber in an upward direction toward an area of less rich concentration. In other embodiments, the connecting wall has no inclinations and is relatively horizontal across the bottom surface between the upright walls.

In any of the designs, the thickness of the walls are thick enough to provide structural rigidity over the life of a container, but not so thick they consume valuable space in the container that could be otherwise occupied by ink. In one design, the walls are about 1-4 mm thick. Also, each wall is about the same thickness as every other wall and about the same thickness t as the bottom surface 18.

In each of the upright walls, second and third fluid inlet ports F2, F3 are found. They are located above the bottom surface 18 at a height of at least 2.0-3.0 mm. The shape of their ports is roughly the same as one another and the same as the topmost inlet port. They are defined by substantially elongated walls 61, 63 connected together at a distal end by a circular wall section 169. The ports direct flow at these locations toward areas of more rich concentration. At a proximate end, each of the ports defines an opening that fronts a sealing film 70 (inset). The film is staked to an endless boundary B of the container to effectively seal the fluid in the interior, but is otherwise gapped G2 from the proximate openings of the inlet ports F1-F3. The film is also gapped from the wall(s) 63, 65, 67, 69 defining the mixing chamber. In this way, the film prevents leakage of fluid from the container, but small amounts of ink can enter the chamber at the gap between the wall and film. The gap serves to avoid stranding ink at the bottom of the chamber that would otherwise exist when fluid in the tank is depleted beneath the lowermost inlet ports F2, F3.

At a back of the mixing chamber, the wall(s) of the chamber abut a central support 40. It has been found that the further away the inlet ports reside from the support, the more useful they are in drawing ink into the chamber interior. In other embodiments, however, there could be inlet ports residing at differing distances from each of the sealing film and central support. There is also no requirement that each wall of the mixing chamber support a fluid inlet port, that each port has a specified size or shape, or that only one inlet port exists in a given wall. Instead, the inventors have noticed that a preferred construction is to provide a ratio of inlet port cross-sectional areas so that the volume of fluid being allowed to pass into the mixing chamber is greater for the higher inlet ports as compared to the lower inlet ports. In this instance, the inlet port F1 on the connecting wall has a greater cross section than the cumulative cross sections remaining for the two inlet ports F2, F3 on the upright walls. The ratio of cross-sectional areas for most designs will range from about one (1) to about five (5). An optimal ratio exists at about two and one half (2.5). The greater the ratio, the more that fluid is drawn from a top of the mixing chamber where the pigment in the container is more diluted than from lower where the pigment is more concentrated (and vice versa). The design also yields slower consumption of the ink in the lower layers of the container near the bottom surface 18 along with faster consumption of the higher layers of ink having a more nominal pigment concentration. In the chamber, the diluted ink and the concentrated ink mix together for delivery to the imaging device. Parent U.S. patent application Ser. No. 12/948,122 shows the improved results.

With reference to FIGS. 1A-3, the shape of the supply item is implicated by good engineering practices, including contemplation of a larger imaging context in which it is used. In the design given, the supply item is generally rectangular and elongated from a back side 39 to a port side 41. The port side inserts forward in the direction of Arrow A into a container slot 200 in an imaging device, while the back side is acted upon by users for pushing. The shape also includes substantially symmetrical interior and exterior halves IH1, IH2 and EH1, EH2. The exterior halves EH1, EH2 join together by snap-fitting, welding, etc. at a seam (S) about the interior halves IH1, IH2 on opposite sides of the central support 40. The exterior halves are rigid to maintain the external shape of the housing of the supply item and are durable over a lifetime. Their material is any of a variety, but is selected from plastic, glass, metal, etc. and is based on criteria, such as cost, ease of manufacturing, shipping, storage, etc.

Figure 3:
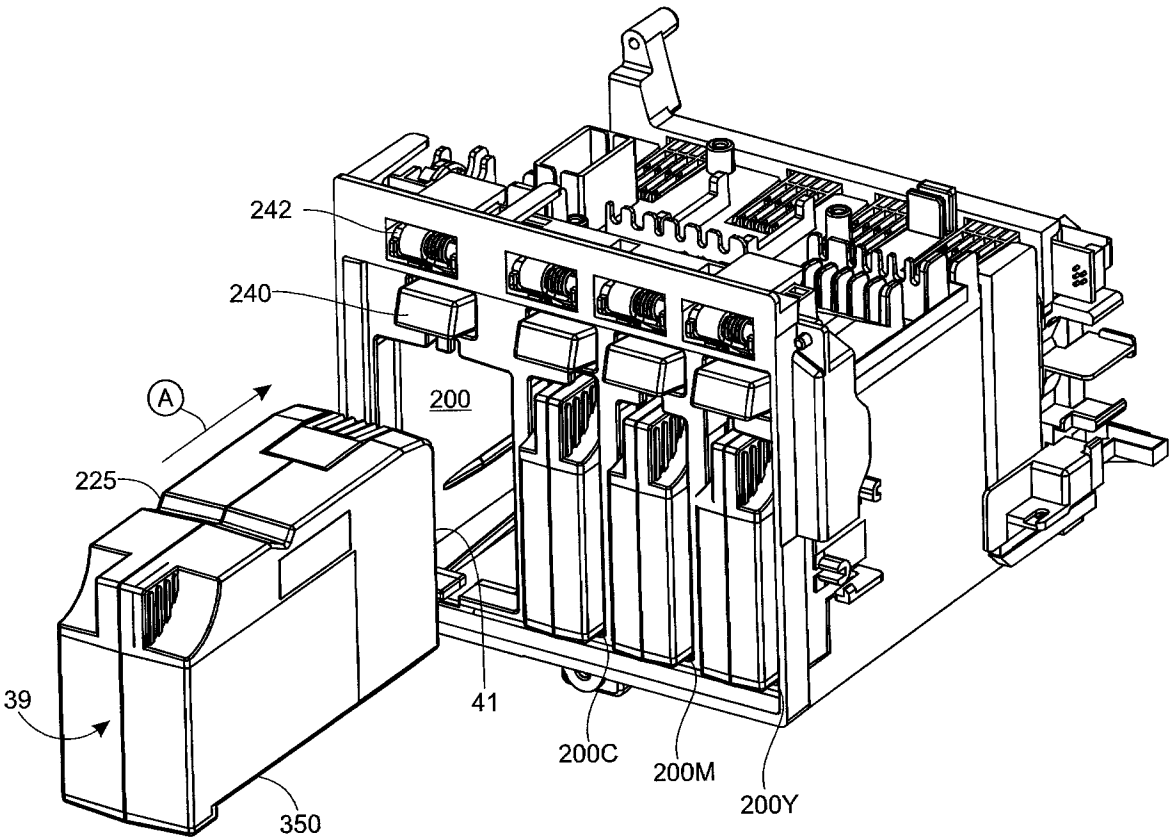
FIG. 3 is a perspective view of the supply item of FIG. 2 inserted for use in a container slot of an imaging device.
Figure 4:
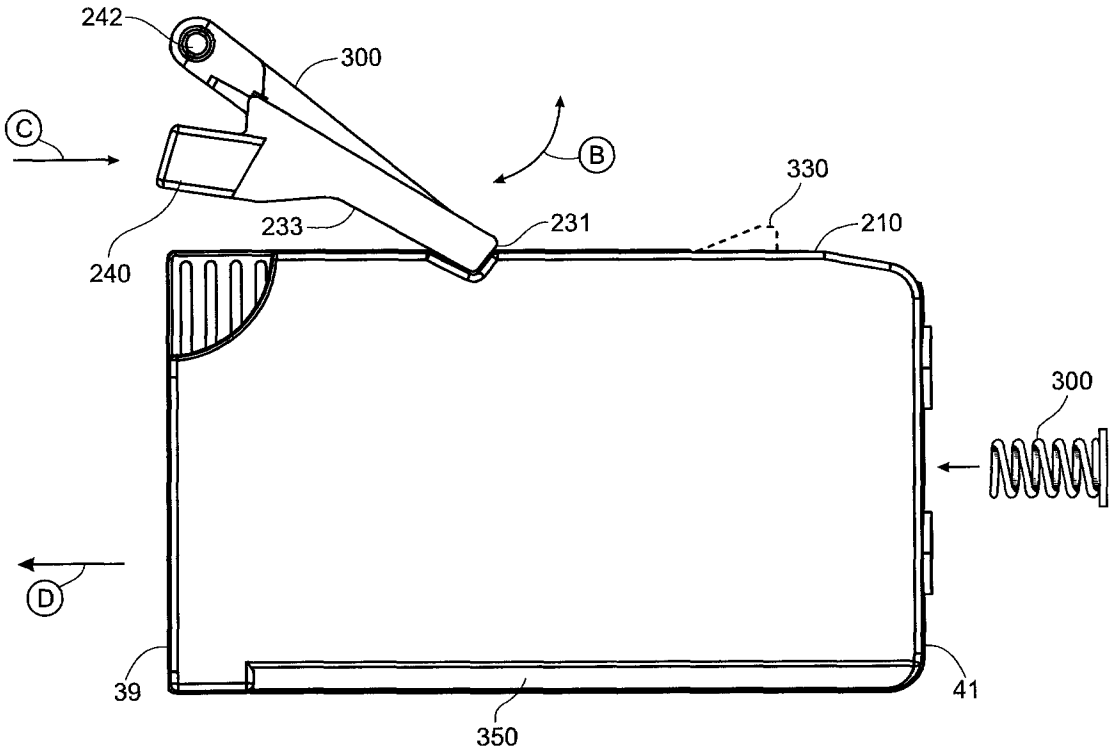
FIGS. 4 and 5 are side views of the supply item including its relationship to the latch of the imaging device.
Figure 5:
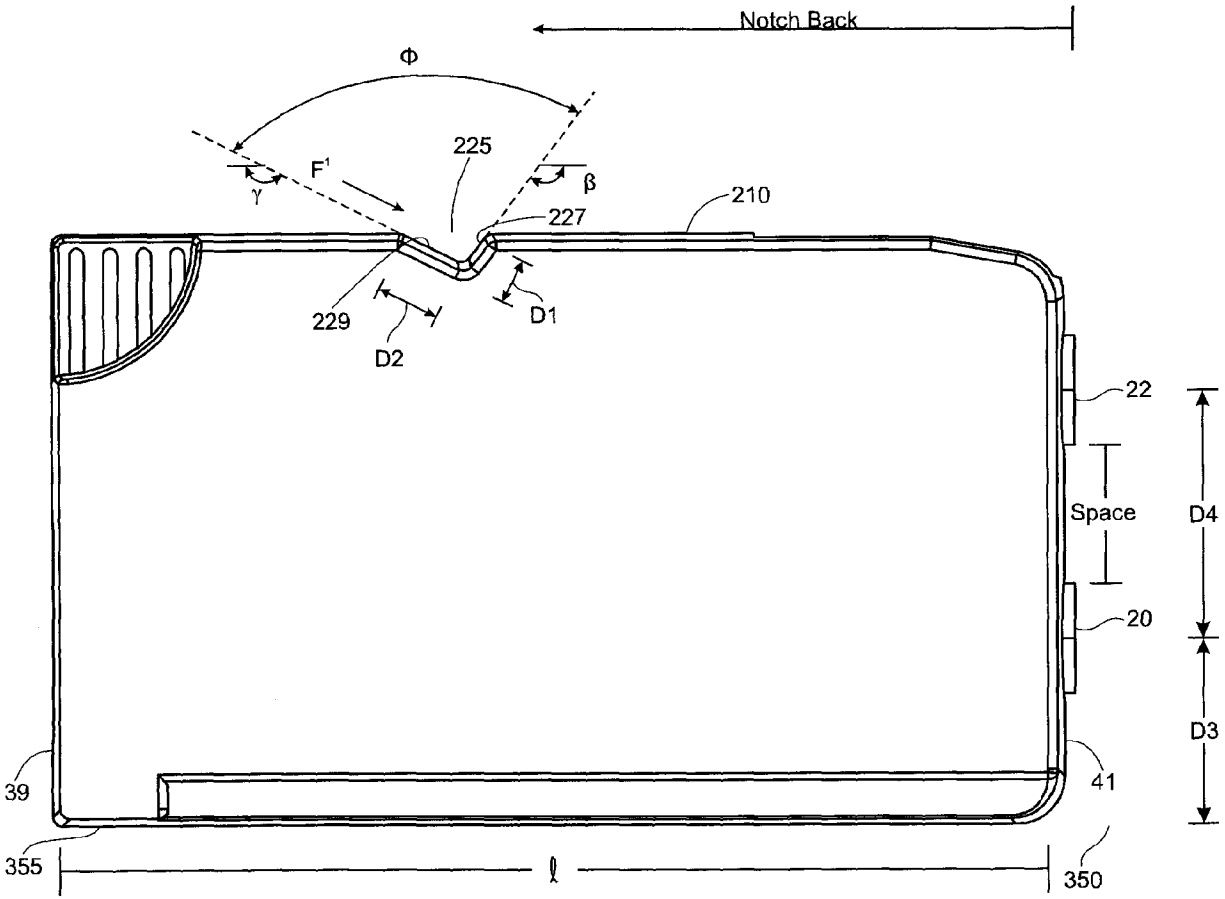

Along a top exterior surface 210 of the housing is a notch 225. The notch mates with a rotating latch of the imaging device to keep in place the supply item during use. With reference to FIGS. 3-5, the notch 225 has a first face 227 to engage a front 231 of the latch and a second face 229 to engage a side 233 of the latch. The first face is angled relative to the top exterior surface to allow the latch 300 to swing into and away from contact with the notch (Action Arrow B) while the second face substantially parallels the side of the latch when the latch is engaged with the first face. The notch is positioned on the housing such that a force vector (F') from the latch perpendicular to the front face of the notch is aligned to bias forward the port side 41 of the housing that gets inserted first into the imaging device where the fluid exit port resides. This securely seats the housing in the imaging device and keeps the exit and air venting ports 20, 22 engaged with the imaging device to flow the volume of fluid to the imaging device without leaking.

After use, users activate the latch 300 by pushing (Action Arrow C) on a latch extension 240. The push rotates the latch about pivot point 242 upward and away from contact with the notch. (As the notch of the supply item resides back from the port side of the housing 41 by more than 50% of the length (1) of the housing, this keeps relatively short a length of the latch in the imaging device. Otherwise, the latch would need to be longer and the pivot point higher (to keep the same force vector F') thereby taking up more space in the imaging device.)

A biasing member 300 of the imaging device pushes upon the supply item at a space between the two ports 20, 22 to eject backward (Action Arrow D) the supply item a sufficient distance to clear the latch from engagement with the notch. Users then engage (pinch) a grasping handle 310 on the back side of the housing to retract fully the supply item from the container slot 200. To keep the space open and available for contact by the biasing member, a distance D4 between a center of the fluid exit port 20 and a center of the air venting port 22 is maintained in a range of about 25 mm-27 mm. At the same time, the center of the fluid exit port resides no more than 20 mm above a bottom surface 355 to minimize stranding the volume of ink in the interior (D3). In optional embodiments, a keying structure 330 resides on the housing to coordinate colors in the supply item with proper container slots based on ink, e.g., 200C, 200M, 200Y. Similarly, a chamfer 350 along the length of the bottom serves as a further locating feature for seating the housing a proper container slot.

With continued reference to FIG. 5, the top exterior surface 210 of the housing is substantially flat and each of the first and second faces of the notch 225 angle from it in substantially differing amounts. In a representative design, the first face angles (β) from the top surface in a range of about 124 to about 127 degrees. Similarly, the second face angles (γ) from the top surface in a range of about 152 to about 155 degrees. Also, the first and second faces define an angle (Φ) between them in an amount of more than 90 degrees to prevent the latch from binding or catching during de-latching of the supply item and more precisely about 98 to 100 degrees (99.4 degrees optimum). In length, the second face of the notch is longer than the front face (D2>D1). Their amounts range from about 7-10 mm for D2 and about 3-7 mm for D1. Alternatively, the second face could be eliminated in lieu of only a single face 227 extending from the top exterior surface 210. In such an instance, angle γ would range from about 152 to about 180 degrees, whereby the second face is coextensive with the top exterior surface.

Figure 6:
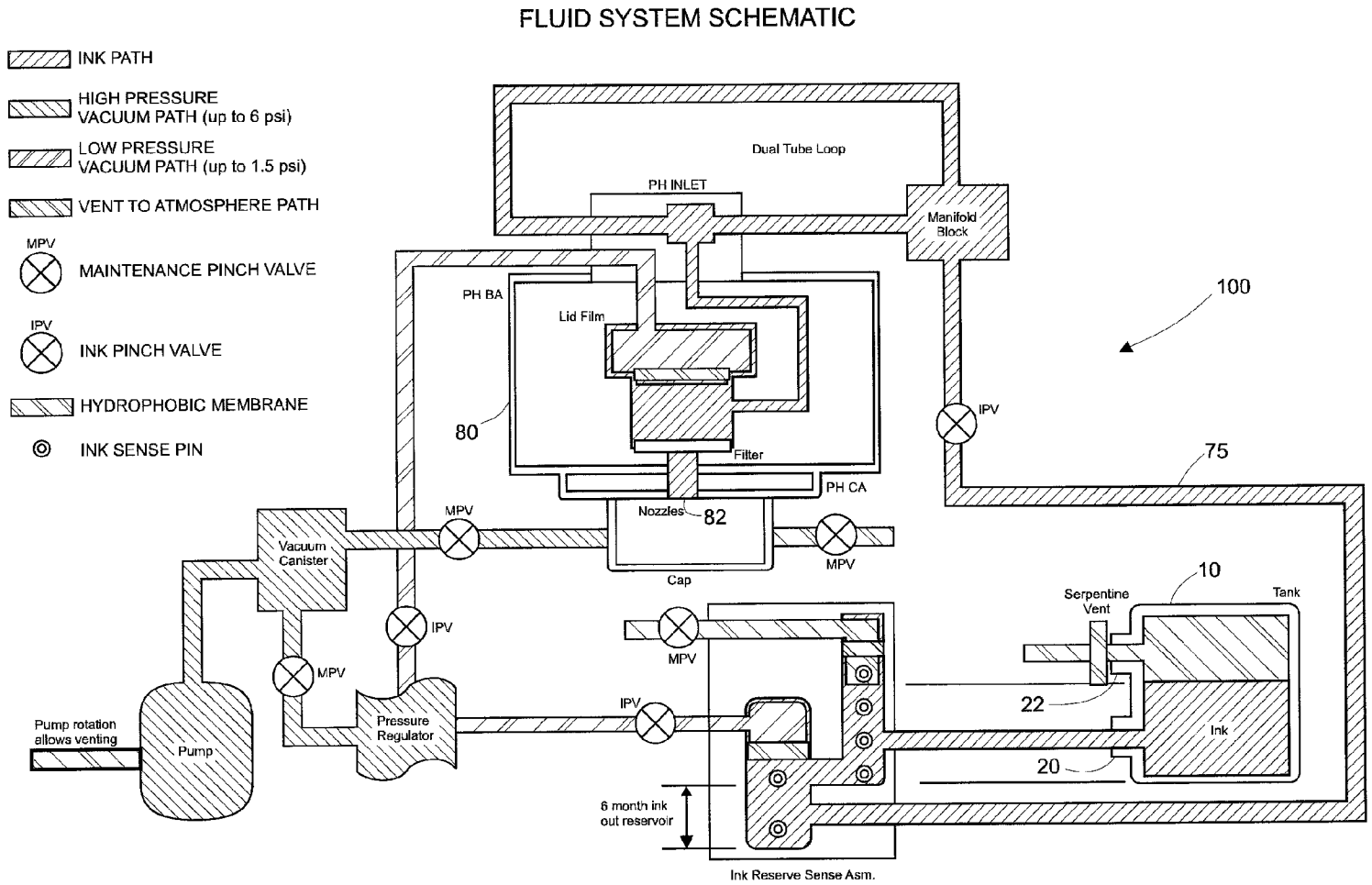
FIG. 6 is a schematic view of the supply item deployed in an imaging device.

With reference to FIG. 6, a schematic view is given of an ink container 10 deployed in an imaging device 100. Fluid paths extend from the fluid exit port 20 and air vent port 22. The fluid is delivered in a channel 75 to a printhead 80 (PH) for ejection from nozzles 82 for imaging media. The printhead is of the permanent or semi-permanent type. The supply item container is replaced numerous times over the life of the imaging device. At port 22, the container 10 is vented to atmosphere.

Relatively apparent advantages of the many embodiments include, but are not limited to: (1) delivering essentially all the fluid in a container to an imaging device; (2) delivering the fluid in such a manner that the pigment concentration of the ink exiting the container has uniform properties over the lifetime of the container; (3) providing a mixing chamber at little cost to the container design; (4) providing passive mixing of pigmented ink without needing mechanical stir bars or other complex mechanisms; and (5) appropriately interfacing the container with an imaging device.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A consumable supply item to hold an initial or refillable volume of ink for use in an imaging device, the supply item arranged for forward insertion into a container slot in the imaging device, the imaging device having a rotating latch to keep in place the supply item during use that users activate to eject the supply item from the container slot after use by way of a biasing member in the imaging device acting on the supply item, comprising:

a housing defining an interior to retain the volume of ink, the interior oriented during use to deplete the volume of fluid in a direction of gravity toward a bottom surface of the interior, the housing having a top exterior surface to engage the latch of the imaging device to securely seat the housing in the imaging device to flow the volume of fluid to the imaging device without leaking; and a fluid exit port and an air venting port on a side of the housing that gets inserted first into the container slot of the imaging device, wherein a space separates the fluid exit port from the air venting port so that said biasing member of the imaging device can push directly on the side of the housing at said space to eject the supply item from the container slot of the imaging device upon the users activating the latch, the air venting port residing above the fluid exit port as oriented during use and above the volume of ink.

2. The supply item of claim 1, wherein a center of the fluid exit port resides no more than 20 mm above the bottom surface to minimize stranding the volume of ink in the interior.

3. The supply item of claim 1, wherein a distance between a center of the fluid exit port and a center of the air venting port is about 25 mm-27 mm to maximize said space for the biasing member.

4. The supply item of claim 1, wherein the air venting port is at least 2 mm above the volume of ink in the interior when full.

5. The supply item of claim 1, wherein the fluid exit port and the air venting port are aligned vertically on the side of the housing that gets inserted first into the container slot of the imaging device.

6. The supply item of claim 1, wherein the housing further includes a chamfer along a length thereof near a bottom exterior to serve as a locating feature of the housing for seating in a proper said container slot.

* * * * *